US007021900B2

(12) United States Patent
Prueitt et al.

(10) Patent No.: US 7,021,900 B2
(45) Date of Patent: Apr. 4, 2006

(54) VAPOR-POWERED KINETIC PUMP

(76) Inventors: Melvin L. Prueitt, 161 Casacabel, Los Alamos, NM (US) 87544; Reed J. Jensen, 121 La Vista, White Rock, NM (US) 87544; Ernst C. Janzen, 2774 Sechelt Drive, North Vancouver (CA) V7H1P2

( * ) Notice: Subject to any disclaimer, the term of this patent is extended or adjusted under 35 U.S.C. 154(b) by 0 days.

(21) Appl. No.: 10/945,507

(22) Filed: Sep. 20, 2004

(65) Prior Publication Data

US 2005/0079070 A1 Apr. 14, 2005

Related U.S. Application Data

(60) Provisional application No. 60/509,975, filed on Oct. 8, 2003.

(51) Int. Cl.
*F04F 1/06* (2006.01)

(52) U.S. Cl. ..... 417/53; 417/92; 417/137

(58) Field of Classification Search ..... 417/53, 417/118, 137, 144

See application file for complete search history.

(56) References Cited

U.S. PATENT DOCUMENTS

| | | | | |
|---|---|---|---|---|
| 32,030 | A * | 4/1861 | Martin | 417/118 |
| 49,063 | A * | 8/1865 | Atwater | 417/118 |
| 1,055,880 | A | 3/1913 | Coster | |
| 4,201,049 | A | 5/1980 | Tobber | |
| 5,461,858 | A | 10/1995 | Johnson | |
| 5,525,042 | A * | 6/1996 | Batten | 417/113 |
| 5,551,237 | A | 9/1996 | Johnson | |
| 5,713,202 | A | 2/1998 | Johnson | |
| 5,865,086 | A | 2/1999 | Petichakis P. | |
| 6,182,615 | B1 | 2/2001 | Kershaw | |

* cited by examiner

*Primary Examiner*—Charles G. Freay
(74) *Attorney, Agent, or Firm*—Rod D. Baker; Peacock Myers, P.C.

(57) ABSTRACT

A kinetic pump and method of pumping a liquid comprising providing an acceleration tube for the acceleration of a liquid contained therein by an introduced high-pressure vapor or gas, receiving the liquid from the acceleration tube with a compressed-air surge tank, admitting the liquid from the acceleration tube into the compressed-air surge tank via a check valve, draining the liquid from the compressed-air surge tank from an outlet, and adding additional liquid to the acceleration tube via an inlet, wherein during each first half cycle of the method, the vapor or gas forces the liquid to accelerate in the acceleration tube, whereby a portion of the liquid is forced into the compressed-air surge tank, and wherein during each second half cycle of the pump, the vapor or gas is substantially removed from the acceleration tube and the liquid flows back to its original location and the additional liquid is added to the liquid.

40 Claims, 8 Drawing Sheets

VAPOR-POWERED KINETIC PUMP

CROSS-REFERENCE TO RELATED APPLICATIONS

This application claims the benefit of the filing of U.S. Provisional Patent Application Ser. No. 60/509,975, entitled "Vapor-Powered Hydraulic Ram Pump", filed on Oct. 8, 2003, and the specification thereof is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to direct gas-to-liquid pump apparatuses and methods.

2. Description of Related Art

Hydraulic ram pumps have been used for many decades to pump small volumes of water to high pressures utilizing large volumes of water from low-pressure sources. In the process, much of the low-pressure water is discarded. More recently steam and other vapors have been proposed to pump water or other liquids directly. Petichakis in U.S. Pat. No. 5,865,086 discloses a method in which high-pressure steam is introduced into the top of vertical cylinders filled with a liquid. The steam forces the liquid out the bottom of the cylinder. This can serve as a pump to move the liquid to a desired destination, or the liquid can be used to drive a turbine to generate electricity.

Johnson in U.S. Pat. Nos. 5,461,858, 5,551,237, and 5,713,202 describes a method of utilizing combustion gases from a power plant to drive water out of vertical cylinders, and the water is used to drive a turbine to generate electricity. Kershaw in U.S. Pat. No. 6,182,615 describes a method in which combustion gases are ignited above a liquid in a tank to drive the liquid out to a storage tank from which the liquid flows to a turbine to generate electricity.

The advantage of these inventions is that they can use pressurized gases in order to pump liquids directly without pistons, turbines, and gearboxes.

The main problem with these and other patents that utilize a gas or vapor to push a liquid out of a tank is that they inefficiently use the energy in the gas. For example, in U.S. Pat. No. 5,865,086, steam at constant pressure forces the liquid out of a cylinder. At that point, most of the energy is still in the high-pressure steam. When a valve is opened to release the steam, the energy of expansion of the steam is lost. The thermal efficiency of this system is about 10% even when the steam temperature is high. In U.S. Pat. No. 6,182,615, the combustion gases expand to force the liquid out of the cylinder, but the pressure in the storage tank must be considerably less than the maximum pressure of the combustion gases. If the pressure in the storage tank is high, only the high-pressure portion of the combustion expansion will be effective, and the efficiency will be low.

Coster in U.S. Pat. No. 1,055,880 and Tobber in U.S. Pat. No. 4,201,049 describe systems in which slugs of liquid are accelerated by gases to directly turn a turbine. Neither patent describes a method for pumping the liquid to high pressures. In both designs, no provision is made for Taylor instabilities at the gas-liquid interface or for heat loss from the gases to the liquid.

The present invention solves the above problems and greatly increases the efficiency of direct gas-to-liquid pumps utilizing energy from the constant pressure portion of the cycle and then utilizing the adiabatic expansion portion of the cycle. With the invention, the pumped liquid can be at higher pressure than the pressure of the gas. This is done by having a mass of liquid and possibly solid objects in an acceleration tube that are driven by the gas. The force from the gas imparts kinetic energy to the moving mass during a free run through the tube. When the mass of liquid comes to the end of the tube, it strikes a check valve, which is forced open to allow the liquid to enter a high-pressure region. Since the liquid is almost incompressible, if it has high velocity, it can build up high pressures when it is suddenly decelerated. This pressure can open a check valve that is backed by high-pressure gas.

BRIEF SUMMARY OF THE INVENTION

The present invention is of a kinetic pump and method of pumping a liquid, comprising: providing an acceleration tube for the acceleration of a liquid contained therein by an introduced high-pressure vapor or gas; receiving the liquid from the acceleration tube with a compressed-air surge tank; admitting the liquid from the acceleration tube into the compressed-air surge tank via a check valve; draining the liquid from the compressed-air surge tank from an outlet; and adding additional liquid to the acceleration tube via an inlet; wherein during each first half cycle of the method, the vapor or gas forces the liquid to accelerate in the acceleration tube, whereby a portion of the liquid is forced into the compressed-air surge tank, and wherein during each second half cycle of the pump, the vapor or gas is substantially removed from the acceleration tube and the liquid flows back to its original location and the additional liquid is added to the liquid. In the preferred embodiment, the invention further comprises: boiling a working fluid in a boiler, which working fluid becomes the vapor; extracting heat energy from the vapor with a heat exchanger after the vapor exits the acceleration tube and pre-heating the working fluid before the working fluid enters the boiler; permitting the vapor to exit the heat exchanger via a pressure reducer valve, wherein the pressure reducer valve restrains flow of the vapor to retain slightly higher pressure of the vapor in the heat exchanger so that a portion of the vapor can condense and release its latent heat to the working fluid; and extracting heat energy from the vapor with a condenser after the vapor exits the heat exchanger and depositing the heat energy into cooling water. Heat can be supplied to the boiler by a solar energy collector.

A float valve may be employed inside the liquid outlet, which float valve opens an air valve when a liquid level becomes sufficiently high to allow ambient air to enter an end of the acceleration tube near the check valve, wherein the ambient air which enters the acceleration tube is forced into the compressed-air surge tank upon a next first half cycle of operation as replacement air for air that has dissolved into the liquid.

The acceleration tube may comprise a "U" shape comprising a first vertical column in which the vapor or gas enters to accelerate the liquid, a second vertical column which is attached to the compressed-air surge tank, and a bottom portion connecting the first vertical column to the second vertical column. Preferably an insulating float is employed resting upon a surface of the liquid near an entry point of the vapor or gas, the insulating float both decreasing vapor condensation on the surface of the liquid and decreasing Taylor instabilities at an interface between the liquid and the vapor or gas.

The acceleration tube may be substantially vertical, and additionally comprise a pressure chamber and a flexible, stretchable diaphragm, the vertical acceleration tube attached to a top of the pressure chamber, and the flexible, stretchable diaphragm disposed within the pressure chamber to separate the vapor or gas from the liquid. The acceleration tube may also be substantially vertical and comprise a piston within the acceleration tube placing a separation distance between the vapor or gas and the liquid and storing kinetic energy during acceleration by the vapor or gas, the liquid being placed on top of the piston. In this case, the compressed-air surge tank is preferably connected to a top of the acceleration tube and the check valve comprises one or more flapper check valves, and the inlet preferably comprises a first valve admitting replacement liquid into the acceleration tube actuated by the piston, and additionally comprising employing a second valve admitting the vapor or gas into the acceleration tube actuated by the piston and a third valve releasing the vapor or gas from the acceleration tube, the third valve being closed mechanically by the piston and being opened by hydraulic pressure from the liquid.

The acceleration tube may be oriented at any angle and comprise a left piston and a right piston within the acceleration tube for placing separation distances between the vapor or gas and the liquid and for storing kinetic energy during acceleration by the vapor, the liquid being placed at a left of the left piston and at a right of the right piston. In this embodiment, the compressed-air surge tank preferably comprises two compressed-air surge tanks, one connected at a left end of the acceleration tube and another connected at a right end of the acceleration tube. The check valve then preferably comprises one or more flapper check valves on each end of the acceleration tube, and the inlet preferably comprises a first valve means at each end of the acceleration tube for admitting replacement liquid into the acceleration tube actuated by one of the pistons, and additionally comprising employing a second valve admitting the vapor or gas into the acceleration tube actuated by one of the pistons, a third valve releasing the vapor or gas from the acceleration tube, the third valve being closed mechanically by one of the pistons and being opened by hydraulic pressure from the liquid, and an air pipe at each end of the acceleration tube inserted into holes in centers of the left and right pistons and connected to the compressed-air surge tanks so that air pressure can accelerate the left and right pistons toward a center of the acceleration tube. A transfer piston near each end of the acceleration tube holds the liquid in place and transferring kinetic energy from the left and right pistons to the liquid, a stop ring near each end of the acceleration tube limits travel distance of the transfer pistons, and a check valve at each end of the acceleration tube admits replacement liquid into the acceleration tube.

A sealed cylinder may be employed surrounding a portion of the acceleration tube wherein the vapor or traverses, wherein a portion of the vapor or is allowed to flow into the sealed cylinder to supply heat to that portion of the acceleration tube to prevent condensation of the vapor or gas on interior walls of the acceleration tube.

The invention is particularly useful to pump high-pressure saline water into a reverse osmosis unit for desalinating water. The invention pumps a large volume of liquid at low pressure utilizing a small volume of vapor or gas at high pressure. A turbine or a positive-displacement engine attached to the liquid outlet may be employed for the production of shaft power, an external combustion means may be employed to supply the vapor or gas to accelerate the liquid, and/or an internal combustion means within the acceleration tube may be employed to accelerate the liquid.

It is therefore an object of the present invention to provide a direct gas-to-liquid pump that can pump liquids to very high pressures efficiently. The gas can be a vapor (such as steam) from a boiler, from an internal combustion process, or other source of high-pressure gas.

Another object of the present invention is to reduce the cost of construction of high-pressure pumps.

Still another object of the present invention is to provide a method of using solar energy to boil a liquid and to use the resulting vapor to pump liquids. A parabolic reflecting dish or a trough collector can be used to collect the solar energy.

Yet another object of the present invention is to use solar energy or other heat source to boil a liquid and to use the resulting vapor to pump seawater (or brackish water) to high pressure for introduction into reverse osmosis cylinders to produce fresh water.

An additional object of the present invention is to use gases to pump high-pressure liquids that are then used to drive a turbine, such as a Pelton Wheel, that turns an electric generator.

Another object of the present invention is to use high-pressure gases to pump large quantities of low-pressure liquids.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
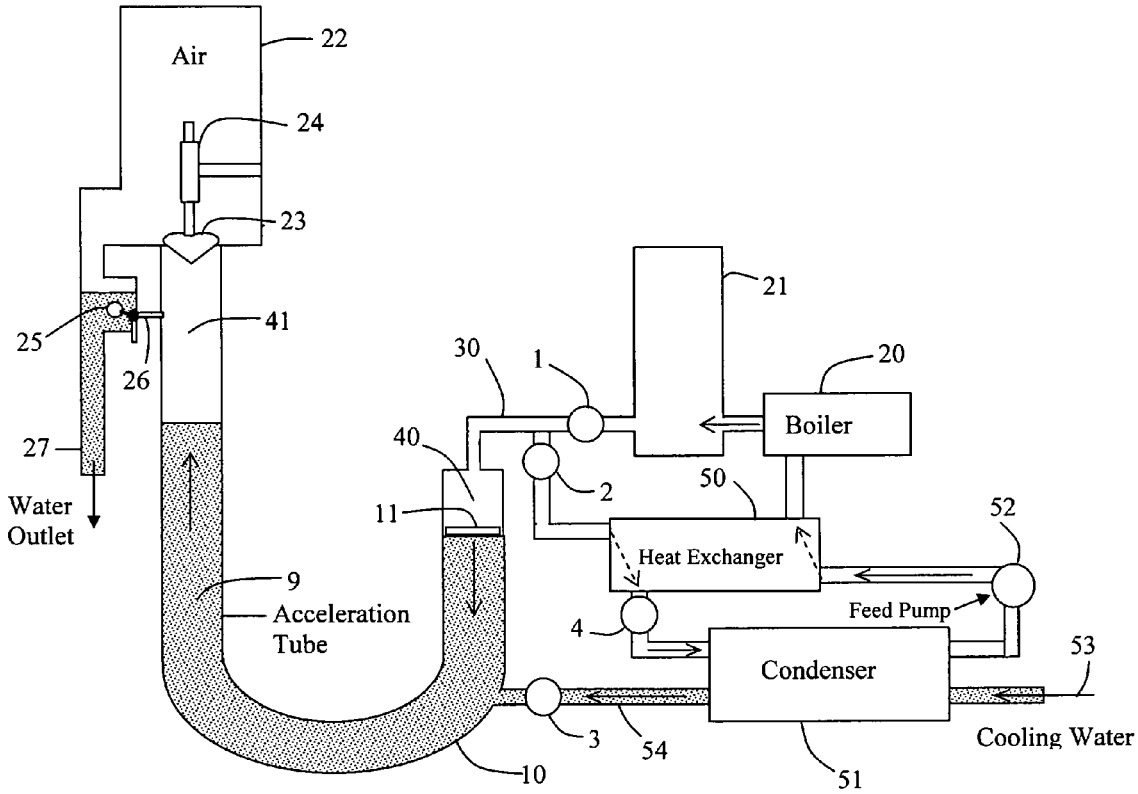
FIG. 1 is a cross-sectional schematic of one embodiment of the present invention.

The present invention is of an apparatus and method that utilizes a pressurized vapor or gas to pump a liquid. The vapor enters an acceleration tube containing the liquid and forces the liquid to accelerate during a free run. The initial displacement of the liquid by the in-flowing vapor and the adiabatic expansion of the vapor contribute to the kinetic energy of the liquid, thus providing high pumping efficiency. When the liquid reaches the end of the acceleration tube, it strikes and opens a check valve so that the liquid flows into a compressed-air surge tank. The pressure in the surge tank can be considerably higher than the initial pressure of the vapor. The vapor can be supplied by a boiler heated by solar energy or other heat source. A pressurized gas can be supplied by internal or external combustion. The device can use relatively low-pressure vapor to pump high-pressure saline water into a reverse osmosis unit to produce fresh water. The device can also pump liquids for power production and for many other purposes.

An exemplary application of the invention meets the existing need for high-pressure solar-powered pumps that impel seawater or brackish water into reverse osmosis (RO) systems to produce fresh water. In prior art, solar dish or trough collectors can produce steam to drive a turbine that drives a high-pressure seawater pump. For systems operating from a single dish, small steam turbines typically have efficiencies of about 25%. Connected to a gearbox and the pump, which have efficiencies of about 85% each, the overall efficiency of the system is about 18%.

Also in prior art, steam or other working fluid can be used as a high-pressure gas to pump water directly by simply having a vertical cylinder filled with the water and then admitting the steam into the top of the pipe. The steam forces the liquid out the bottom. After the water is flushed, the steam valve is closed, and another valve is opened to allow the steam to flow into a condenser to be condensed to a liquid and returned to the boiler. After the pressure is released, the cylinder is re-filled with water, and the cycle is repeated. This would make a very simple pump that could use solar energy to heat the boiler. It could be used to pump high-pressure salt water into an RO cylinder to desalinate the water.

The problem with this prior art system is that the steam is at constant pressure as it forces the liquid out of the cylinder, and the heat energy in the steam is not used. The steam is released in a free expansion. If the gas could be allowed to expand adiabatically, it could do more work as it cooled in the expansion. But the pressure would immediately drop below the required pressure of the RO unit, and the pumping action would cease. That defines another disadvantage to this method: the steam pressure must be as great as the pressure of the pumped water.

The present invention employs a novel method that allows adiabatic expansion of the steam (or other vapor or gas) and yet pumps high-pressure water (or other liquid) in an energy efficient manner. The pumped water can be at much higher pressure than the pressure of the steam.

In the description of the preferred embodiments, for simplicity of description, the terms "water" and "steam" will be used for the liquid and the working fluid, respectively, but it should be understood that other liquids and gases could be used. The described system assumes solar energy as the heat source and assumes that the output high-pressure water is for an RO desalination plant, although it should be understood that any heat source could be used, and the system can be used to pump any liquid to high or low pressures.

In FIG. 1, boiler 20 is heated by solar energy. For a solar-heated system, during times of cloudiness or at night, the boiler can be heated by other means. Water is boiled and superheated in the boiler. Valve 1 opens to allow a small amount of steam to flow into chamber 40 in acceleration tube 10. As the steam enters, it begins to accelerate the water 9 in the tube. Valve 1 is then closed, and the steam above the water expands adiabatically and continues to accelerate the water in acceleration tube 10. It should be noted that the work done on the water, both during the initial displacement and during the adiabatic expansion, is converted into kinetic energy of the body of water. The water continues to accelerate until the "front end" of the water in the acceleration tube 10 reaches the other end of the tube and forces check valve 23 open in the compressed-air surge tank 22. The high-pressure air in tank 22 begins to decelerate the water 9, but the water will continue to flow until its kinetic energy is essentially exhausted. Simply stated, the kinetic energy of the water in acceleration tube 10 is converted into potential energy of high-pressure water in the surge tank 22.

Only a part of the water 9 in the acceleration tube 10 enters the compressed-air surge tank 22, but the kinetic energy of all the water in the acceleration tube 10 provides the "ram" that forces the water into a higher-pressure region. As the water in the front encounters the high-pressure air, the momentum of the rest of the water continues to push. This has some similarity to the old hydraulic ram in which a low head of water was used to pump water to a higher head.

After this part of the cycle has ended, valve 2 opens and allows the steam from chamber 40 to flow through heat exchanger 50, where it pre-heats the feed water flowing to the boiler 20. Then the water flows through throttle valve 4 into the condenser 51 where it is condensed to a liquid by cool inflowing seawater 53. This heats the incoming seawater that then flows to an RO unit (not shown) via the acceleration tube 10, surge tank 22, and outlet pipe 27. Having the seawater warmer makes the RO process more efficient. The condensed feed water is pumped back to the boiler 20 by feed pump 52. This feed pump could actually be a small steam-powered kinetic pump similar to the invention described herein.

As the steam is condensed, the acceleration tube 10 is left with a partial vacuum above the water in both chambers 40 and 41. Gravity moves the water back to its starting position.

Replacement water is drawn into the acceleration tube 10 through valve 3. The cycle is then repeated.

The reason for having the compressed-air surge tank 22 at the point where the water enters the high-pressure region is to prevent the incoming water 9 from immediately colliding with water already present in the high-pressure region. Without the air cushion, the incoming water would have to accelerate the local water, and that can be difficult if there is a long outlet pipe filled with water, since water is essentially incompressible at the pressures involved (about 0.1% compression in going from atmospheric pressure to 1,500 psi). With the air present, the incoming water can collide with low-density air and compress the air. The volume of the surge tank 22 should be sufficiently large so that the air pressure does not rise significantly during the inflow of water. After the incoming water 9 enters the high-pressure region, it drains to the outlet pipe 27 and then flows to the RO unit (or to other end use).

Since air is soluble in water, replacement air is needed. In the water outlet pipe 27, there is an attached compartment in which a float valve 25 detects the level of the water. When the water level rises too high, float valve 25 opens and lets a small amount of air from the outside flow through a constricted pipe 26 into the partial vacuum in chamber 41. A check valve (not shown) prevents flow in the opposite direction. During the next pump cycle, as the water rushes into chamber 41, the water vapor therein condenses to a liquid, while the air forms small bubbles that are carried into compressed-air surge tank 22.

Alternatively, the compressed air could be kept behind a diaphragm close to the check valve 23 so that the incoming water would push against the diaphragm to compress the air.

Check valve 23 is supported by sliding support 24. A spring can be placed between support 24 and check valve 23 in order to keep the check valve 23 closed.

Some of the steam entering the acceleration tube 10 condenses on the tube wall and represents a loss in energy. The wall should be lined by an insulating material to minimize this effect. An insulating float 11 is placed on top of the water to reduce condensation on the water surface. Without this float, steam would begin to condense on the water surface and quickly heat a thin layer of water on the surface to reach equilibrium. If the action is fast, the steam condensation can be made small. The float also eliminates the effect of Taylor instability of the interface between the water and the steam as the water is accelerated.

An alternative method of preventing steam condensation on the wall of the acceleration tube 10 is to elongate the float 11 into a fairly long piston to provide a separation distance between the steam and the water. The portion of the acceleration tube 10 near the steam inlet can be heated from the outside, either with a heating element or by having a compartment into which steam could flow. As the steam in the acceleration tube 10 expands, it cools and thus becomes cooler than the wall. It would then absorb heat from the wall, and its expansion would depart from pure adiabatic and would become a little closer to isothermal.

Embodiment Using a Diaphragm

Figure 2:
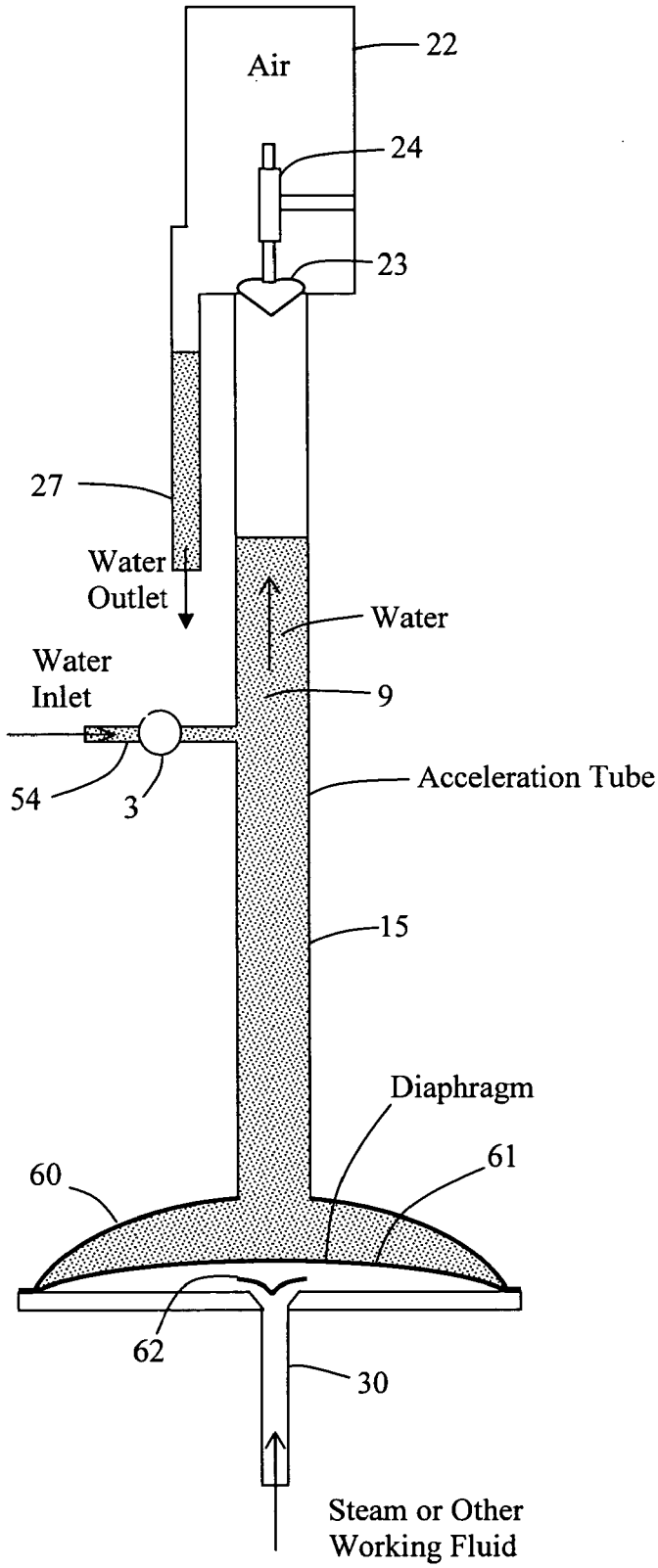
FIG. 2 is a cross-sectional schematic of another embodiment of the present invention showing a diaphragm, which separates the driving gas from the liquid.

FIG. 2 shows a chamber 60 in which a diaphragm 61 separates the working fluid and liquid to be pumped. Many of the details of the system shown in FIG. 1 are left out of this drawing; however it is assumed that those details would be associated with the components in FIG. 2. This design provides a way to reduce steam condensation. With this configuration, working fluids other than steam can be used. The diaphragm 61 should be made of a flexible, stretchable material such as rubber to separate the working fluid from the liquid to be pumped. Most such materials are good thermal insulators. The system would be limited by the working temperature of the material. Nozzle 62 prevents the high-pressure steam flow from concentrating at the center point of the diaphragm 61.

This design functions in a similar manner to the one shown in FIG. 1. High-pressure steam or other vapor enters the bottom of chamber 60 in which there is a diaphragm 61 sealed around the edges. The diaphragm is forced upward and causes the water to flow into the acceleration tube 15. With a partial vacuum ahead of it, the water column accelerates until it hits the check valve 23, and then a portion of the water flows into the compressed-air surge tank 22.

Embodiment Using a Heavy Piston

Figure 3:
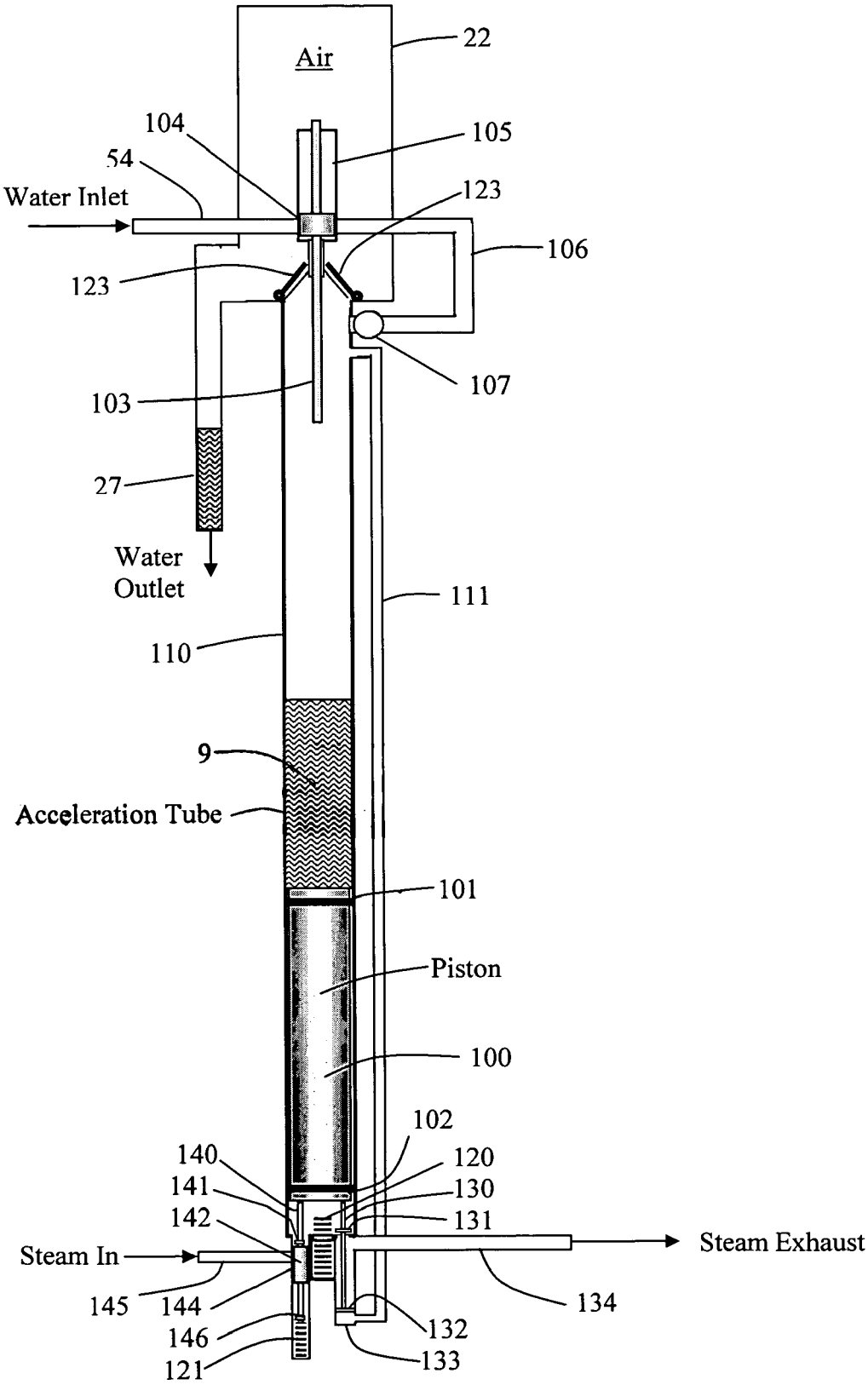
FIG. 3 is a cross-sectional schematic of another embodiment of the present invention showing a vertical acceleration tube in which a heavy piston and liquid are used to store kinetic energy to drive the liquid into a high-pressure tank.

FIG. 3 shows an embodiment in which most of the kinetic energy imparted by the steam is stored in a heavy piston 100 that pushes the water 9. When the water 9 strikes check valves 123, the kinetic energy of the water and the piston force the water into the high-pressure surge tank 22. The piston 100 should be loosely-fitting except near the O-rings 101 and piston rings 102 to prevent friction drag.

At the same time that the water 9 strikes check valves 123, which are flapper type check valves that are spring loaded to keep them closed, piston 100 strikes the end of water inlet control rod 103, which is rigidly connected to valve piston 104. As valve piston 104 moves upward, it opens the port in pipe 54 to allow inlet water to flow into pipe 106. At this time, the pressure in the water 9 in the acceleration tube 110 is too high so that the water in pipe 106 cannot enter acceleration tube 110. Check valve 107 prevents the high-pressure water 9 from flowing into pipe 106. As soon as the pressure drops in the acceleration tube 110, the pressure of the inlet water in pipe 106 forces check valve 107 open and the inlet water flows into the acceleration tube. This is makeup water to replace the water that flowed into the surge tank 22. The pressure of the inlet water helps to accelerate piston 100 downward. Air pressure (in the surge tank 22) on the upper end of the water inlet control rod 103 forces the rod to move downward, following piston 100. When the valve piston 104 covers the port of the water inlet pipe 54, the inlet water flow is halted, and the right amount of makeup water has been deposited into the acceleration tube 110.

Another event that occurs when the water 9 strikes check valves 123 is that high-pressure water is forced into pipe 111 and flows into exhaust steam valve 133. This forces valve piston 132 upward and opens valve 131 to allow the steam in the acceleration tube 110 to escape through steam exhaust pipe 134, which leads to the steam condenser. The reason that the lower portion of exhaust steam valve 133 and valve piston 132 are located at some distance downward from the body of the acceleration tube 110 is that some separation and insulation are needed to separate the water in the steam valve 133 from the hot parts of the acceleration tube 110.

After these events, the piston 100 and water 9 continue to accelerate downward under the influence of gravity. When piston 100 strikes steam exhaust valve rod 130, which is spring loaded (spring not shown), it closes the steam exhaust valve.

Piston 100 also pushes the steam valve control rod 140 downward. The rod 140 slides freely inside the steam valve piston 142. When the upper ring 141, which is rigidly mounted on valve rod 140, contacts the steam valve piston 142, it pushes the piston 142 downward. When the top of the piston 142 passes the steam opening in pipe 145, steam flows into the acceleration tube 110 and begins to push the piston 100 upward again.

The valve rod 140 follows the piston 100 upward for a specified distance, being pushed upward by spring 121 at the bottom, to allow the right amount of steam to enter. When lower ring 146, which is rigidly mounted on rod 140, reaches the bottom of the valve piston 142, it pushes the valve piston 142 upward to shut off the steam flow. The steam then expands adiabatically as it continues to push piston 100 upward. Valve pistons 142 and 104 should have vertical holes through them so that pressure is equalized above and below them.

The purpose of spring 120 is to cushion the impact of the piston 100 in case steam pressure fails.

The design in FIG. 3 is faster than that of FIG. 1, since the piston 100 and water 9 can be accelerated downward by the inflowing water and by the air pressure on the upper end of rod 103. Piston 100 can be made of steel, which is considerably denser than water and provides a large mass so that the same amount of kinetic energy can be stored with lower velocities. If the velocities are lower, there would be less wear on the check valves 123.

Embodiment Comprising a Double-Acting Kinetic Pump

Figure 4:
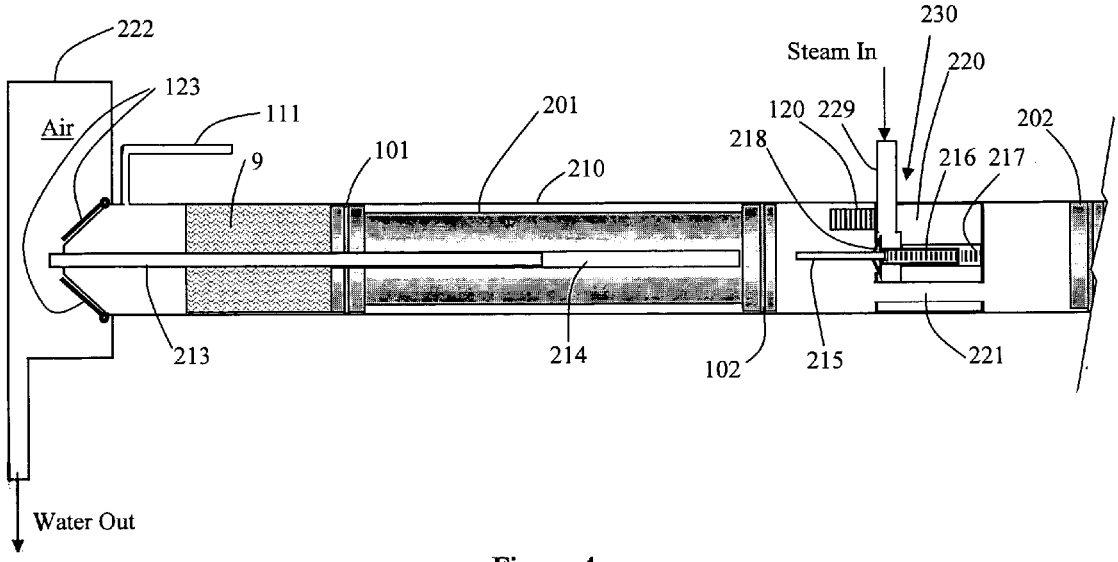
FIG. 4 is a cross-sectional schematic of an embodiment called the Double-Acting Kinetic Pump, which has two pistons that move symmetrically to reduce vibration.

One preferred embodiment of the present invention is called the Double-Acting Kinetic Pump and is shown schematically in FIG. 4. It has two pistons that move symmetrically opposite to each other so that vibration is reduced. Only about half of the system is shown in the figure.

During operation, steam inters at the center of the acceleration tube 210 to force the left piston 201 to the left, and steam flows through the steam channel 221 to force the right piston 202 (with only the end showing in the figure) to the right. Water 9 ahead of the pistons is accelerated toward the ends of the acceleration tube 210. When the water 9 strikes the check valves 123, it forces the check valves open, and some of the water flows into the compressed-air surge tank 222. The check valves 123 are flapper-type valves that are spring loaded to keep them normally closed. The water 9 continues to flow until the kinetic energy of the water 9 and left piston 201 is depleted. The same process occurs in the right half of the assembly.

When the water and the piston stop, high-pressure air from the compressed-air surge tank 222 flows through the air pipe 213 and pushes on the end of the return cylinder 214, which is a hole formed in the center of the piston 201. The force on the end of the return cylinder 214 accelerates the left piston 201 to the right, and a similar system in the right piston 202 accelerates the right piston to the left.

Figure 5:
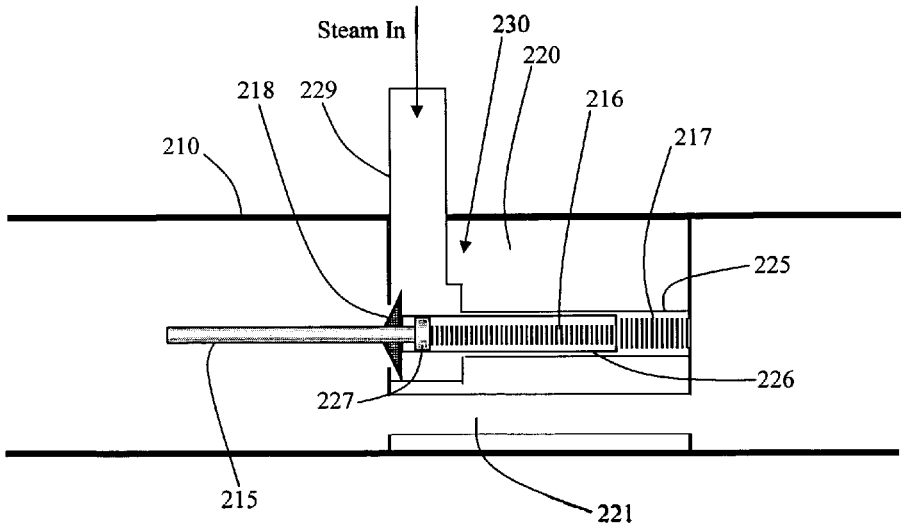
FIG. 5 shows an enlargement of the steam inlet valve for the Double-Acting Kinetic Pump.

FIG. 5 shows an enlarged drawing of the steam inlet valve assembly 230. The steam valve assembly is mounted in the center block 220, which is a solid piece of material that has cavities within which the components are assembled. For very high-temperature operations, the steam inlet valve 218 is designed like intake and exhaust valves in an internal combustion engine. The steam inlet valve 218 has no O-rings, which would not tolerate the high temperature. Its polished surface seals against the valve opening.

When the left piston 201 strikes the steam inlet valve control rod 215, it pushes rod 215 to the right. The rod 215 slides through the center of valve 218. A flange 227 on the end of rod 215 slides inside the valve sleeve 226 and compresses spring 216. The valve sleeve 226 is rigidly attached to the steam inlet valve 218 and is leak-proof to prevent high-pressure steam from entering from the inlet steam pipe 229. Although spring 216 is being compressed by the flange 227 and spring 216 is pressing on the end of the valve sleeve 226, the steam inlet valve 218 does not open, due to the high-pressure steam on the right side of the steam inlet valve 218. When spring 216 is completely compressed, the force on the end of the valve sleeve 226 becomes large enough to force the steam inlet valve 218 open. The movement of the valve sleeve 226 compresses spring 217.

Steam flows into the acceleration tube 210 and forces the left piston 201 to move back to left. Part of the steam flows through the steam channel 221 in the center block 220 and forces the right piston 202 to move to the right. The steam inlet valve control rod 215 follows the left piston 201 due to the force from spring 216. There should be some small holes in the steam inlet valve 218 around the steam inlet valve control rod 215 and in the flange 227 to allow equalization of pressure inside the valve sleeve 226 and inside the acceleration tube 210.

Spring 216 has a higher force constant than spring 217, so that the steam inlet valve 218 does not close. When the appropriate volume of steam has entered the acceleration tube 210 (that is, the steam inlet valve control rod 215 has traveled the right distance), the flange 227 on the end of the steam inlet valve control rod 215 strikes the steam inlet valve 218 from the right. The momentum of the rod and the force from spring 217 forces the steam inlet valve 218 to close.

The left and right pistons (201 and 202) then continue to accelerate as the steam expands adiabatically.

Figure 6:
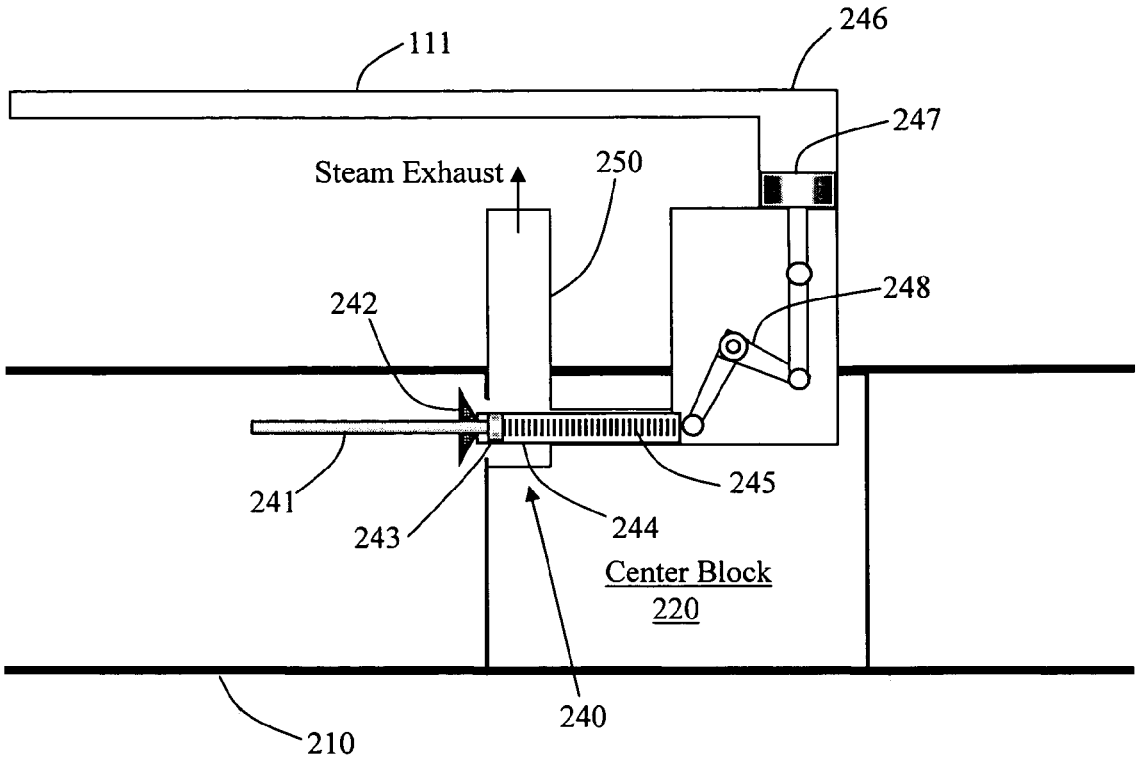
FIG. 6 is a cross-sectional schematic of the steam exhaust valve for the Double-Acting Kinetic Pump.

Another valve component of the system is the steam exhaust valve 240, shown schematically in FIG. 6. Just before the steam inlet valve 218 opens (FIGS. 4 and 5), the steam exhaust valve 242 must close. FIG. 4 does not have sufficient room to show the steam exhaust valve assembly 240, since that figure is a two-dimensional drawing. The assembly shown in FIG. 6 is mounted in the center block further from the viewer (in FIG. 4) than the centrally located steam inlet valve 218.

As the left piston 201 in the acceleration tube 210 strikes the steam exhaust valve control rod 241, its flange 243 pushes on spring 245, which pushes on the end of the valve sleeve 244. The valve sleeve 244 is connected to the steam exhaust valve 242, and the steam exhaust valve 242 closes immediately. The purpose of the spring is to allow the steam exhaust valve control rod 241 to continue to move after the steam exhaust valve 242 stops moving.

After the steam inlet valve 218 opens, the left piston 201 is accelerated to the left, and the steam exhaust valve control rod 241 moves to the left by the force of spring 245. When rod 241 comes to a stop, its momentum is not sufficient to open the steam exhaust valve 242, because high-pressure steam on the left side of the exhaust valve 242 keeps it closed.

When the water in the acceleration tube 210 strikes the check valves 123, the pressure in the water 9 becomes quite high, and some water is forced to flow into the release pipe 111 (portions of which are shown in FIGS. 4 and 6). The water flows into the valve control cylinder 246 and pushes the valve control piston 247, which causes the lever mechanism 248 to push on the end of the valve sleeve 244 and open the steam exhaust valve 242, which allows the steam to flow through pipe 250 to a condenser.

Figure 7:
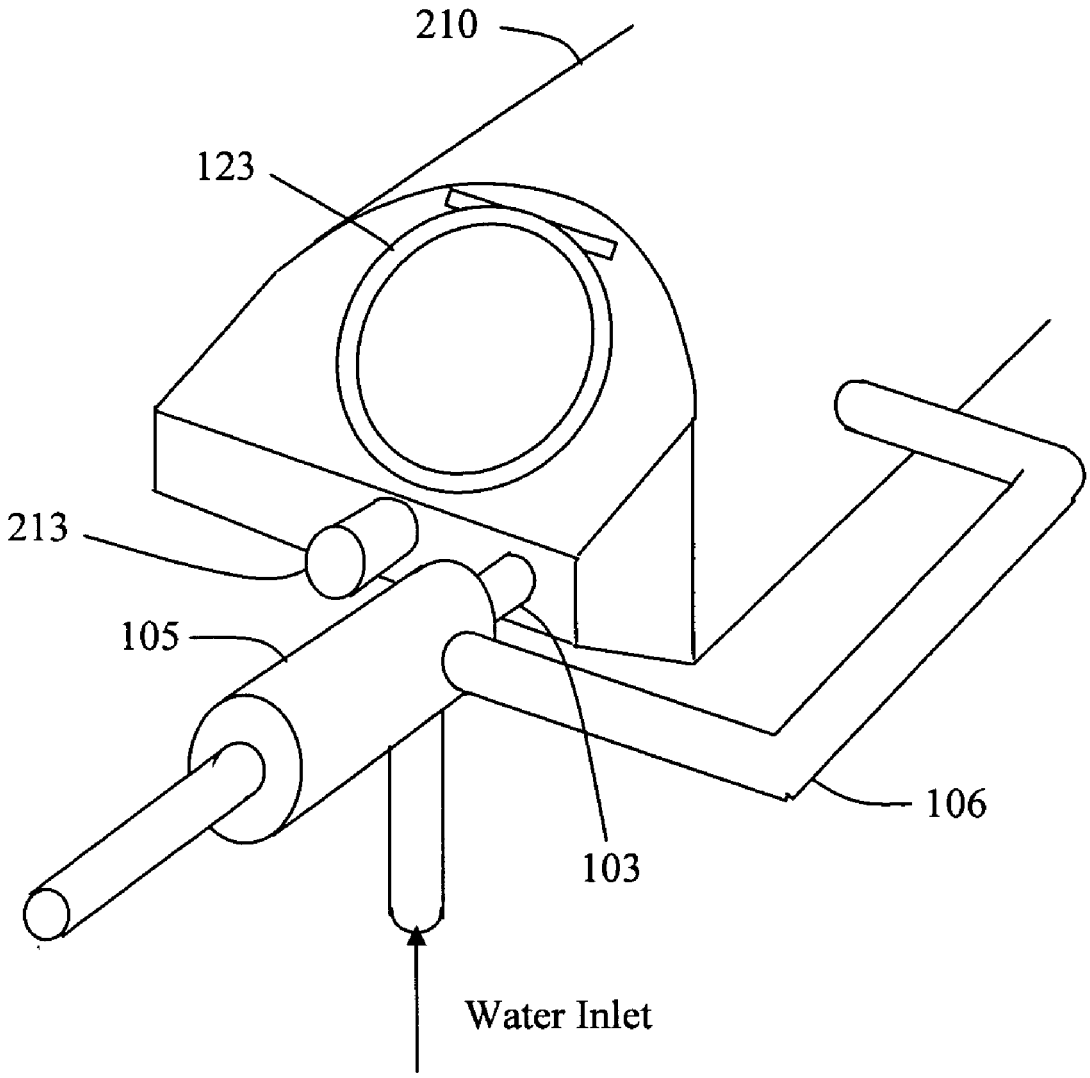
FIG. 7 is a perspective view showing the placement of the water inlet valve for the Double-Acting Kinetic Pump.

At the end of each power stroke, the volume of water that has been forced into the high-pressure surge tank must be replaced in the acceleration tube 210. A system similar to the water inlet valve of FIG. 3 can be used at the left and right ends of this Double-Acting Kinetic Pump of FIG. 4. It is not shown in FIG. 4, but the water inlet control rod can be placed beside the air pipe 213 (nearer the viewer than the air pipe). FIG. 7 is a perspective view that shows the placement of the water inlet valve with respect to the air pipe 213 and check valves 123. The compressed-air surge tank is omitted from the drawing.

Since the Double-Acting Kinetic Pump can be mounted horizontally, as the left and right pistons 201 and 202 are moving toward the center, the water 9 in each end will be attracted by gravity towards the lower part of the acceleration tube 210. When the pistons 201 and 202 are again accelerated toward the check valves 123 at the ends of the acceleration tube 210, the water will not be accelerated uniformly, but this is not a serious problem, since the mass of the water is small compared to the mass of the pistons. The water will be swept up in front of the pistons and accelerated toward the check valves.

The number of cycles per second will be determined by the mass of the pistons 201 and 202 and water 9, by the pressures, by steam mass, and by the diameter of the return cylinder 214. Table 1 gives some computer results from the program Rampump.f for a Double-Acting Kinetic Pump that is pumping water to a pressure of 55.2 bars (800 psi). The steam pressure is 30 bars, and the steam temperature is 700 degrees C. "Tube Radius" is the inside radius of the acceleration tube 210. The pistons 201 and 202 are each one meter long.

TABLE 1

| Steam Mass (grams) | Tube Radius (cm) | Return Cylinder Radius (cm) | Cycle Time Sec. | Water Per Sec. (liters) | Efficiency (%) | Power Required (kW) |
|---|---|---|---|---|---|---|
| 10 | 5.08 | 1.27 | 0.233 | 8.78 | 35 | 137 |
| 10 | 5.08 | 0.635 | 0.300 | 6.82 | 35 | 107 |
| 10 | 3.81 | 0.635 | 0.414 | 4.59 | 32 | 77 |
| 5 | 3.81 | 0.635 | 0.295 | 3.42 | 34 | 54 |
| 10 | 3.81 | 1.27 | 0.203 | 8.62 | 31 | 150 |

At first, it would appear that the pressure from the air pipe 213 pushing on the end of the return cylinder 214 would reduce the effectiveness of the pump, since it is pushing in the opposite direction of the force of steam on the left piston 201, but it should be noted that any energy that is lost due to this force is returned when the left piston 201 is accelerated to the right by air pressure from the air pipe 213. When the left piston 201 nears the right end of its traverse and the steam inlet valve 218 is opened, the left piston 201 performs work on the steam, so that the kinetic energy imparted to the left piston by the pressure from the air pipe 213 is returned to the system. Steel rebound springs 120 (only one is shown) connected to the center block can also absorb the kinetic energy of the left piston and then return the energy to the piston as it is accelerated back to the left.

It should be understood that the numbers in the table are computer calculations, which take into account the dynamics of the system and the flow resistance of the water, but other mechanical and heat-transfer inefficiencies will reduce the performance of an actual device.

Double-Acting Kinetic Pump with Transfer Piston

Figure 8:
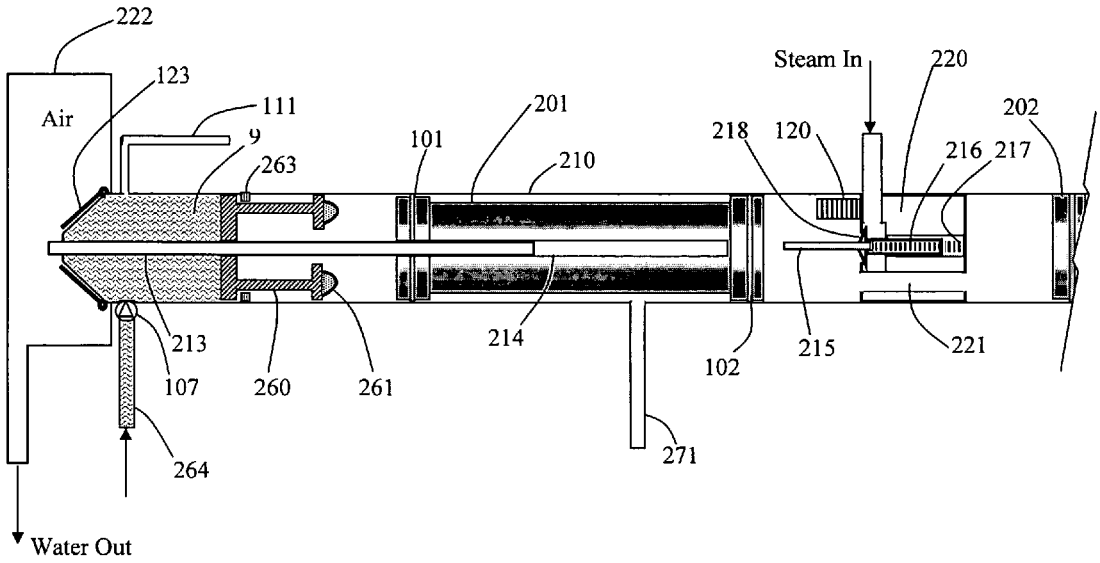
FIG. 8 is a cross-sectional schematic of another embodiment called the Double-Acting Kinetic Pump with a Transfer Piston.

The Double-Acting Kinetic Pump can be modified, as shown in FIG. 8, so that the water 9 in front of the left piston 201 does not have to be "scooped up" as the piston moves forward but rather the water is confined behind a transfer piston 260, which transfers the kinetic energy from the heavy left piston 201 to the water 9. The transfer piston 260 is lightweight. The left piston 201 strikes elastic bumpers 261 (or springs) on the transfer piston 260. The transfer piston 260 immediately begins to force the water 9 through the flapper check valves 123 into the compressed-air surge tank 222.

When the kinetic energy is exhausted, the pressure of the water in the acceleration tube 210 drops, and water from the water inlet pipe 264 flows past the check valve 107 into the acceleration tube 210 to replace the water that was pumped into the surge tank 222. This water pushes on the transfer piston 260, which accelerates the left piston 201 to the right. When the transfer piston 260 reaches the stop ring 263, it stops. At this point, the correct amount of water has entered the acceleration tube 210.

One advantage of this design is that it is not necessary to have a water inlet valve and a water inlet valve control rod penetrating the surge tank as was required in some of the other embodiments. Another advantage is that more time is allowed for the replacement water to flow into the acceleration tube 210. With the first design of the Double-Acting Kinetic Pump, the replacement water had to complete its flow during the short time in which the left piston 201 traveled a short distance. With the design with the transfer piston, the water can continue to flow until the left piston 201 has moved all the way to its rightmost position and then returned back to the transfer piston 260. This allows for faster operation of the pump.

Another advantage of this design is the water 9 is located further from the hot steam.

Of course, the right side of the pump has the same type of operation as the left side. It should be understood that the free run of the pistons 201 and 202 could be considerably longer than is shown in the diagram. This design can be mounted horizontally, vertically, or at some other angle, although some asymmetry is introduced.

Figure 9:
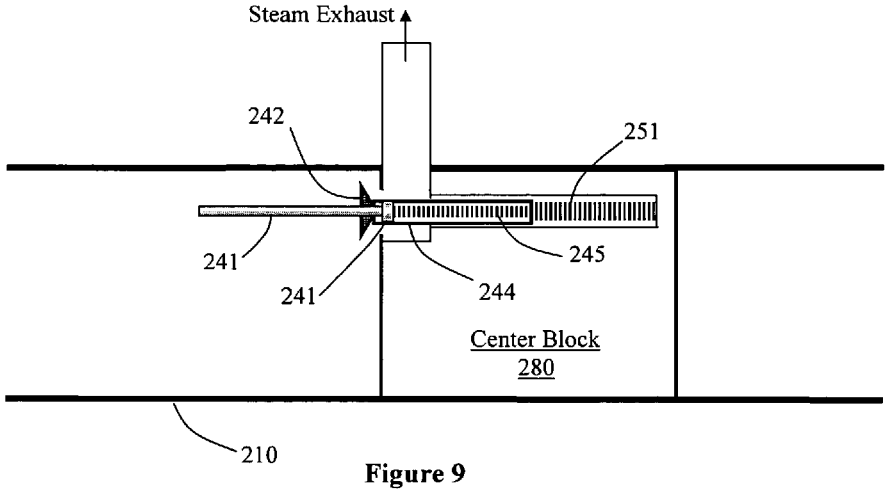
FIG. 9 is a cross-sectional schematic showing a steam exhaust valve assembly.

During the power stroke as the left piston 201 is moving to the left, when the piston ring 102 in the left piston 201 passes the opening to the steam exhaust pipe 271, the steam flows out to a condenser. When the steam pressure drops, the steam exhaust valve 242 shown in FIG. 9 opens, since there is no longer sufficient steam pressure to hold it closed. Note that the valve assembly of FIG. 9 is similar to that of FIG. 6 so that some of the components have the same numbers, but the FIG. 9 design is simpler. Spring 251 provides sufficient force to open the steam exhaust valve 242. As the left piston 201 moves back to the right, it forces the remaining steam to flow out past the steam exhaust valve 242. When the left piston strikes the steam exhaust valve control rod 241, spring 245 is compressed and causes the steam exhaust valve to close. Spring 245 should have a stronger spring constant than spring 251. After valve 242 closes, the steam exhaust valve control rod 241 compresses spring 244 so that the left piston 201 can continue to move to the right.

Figure 10:
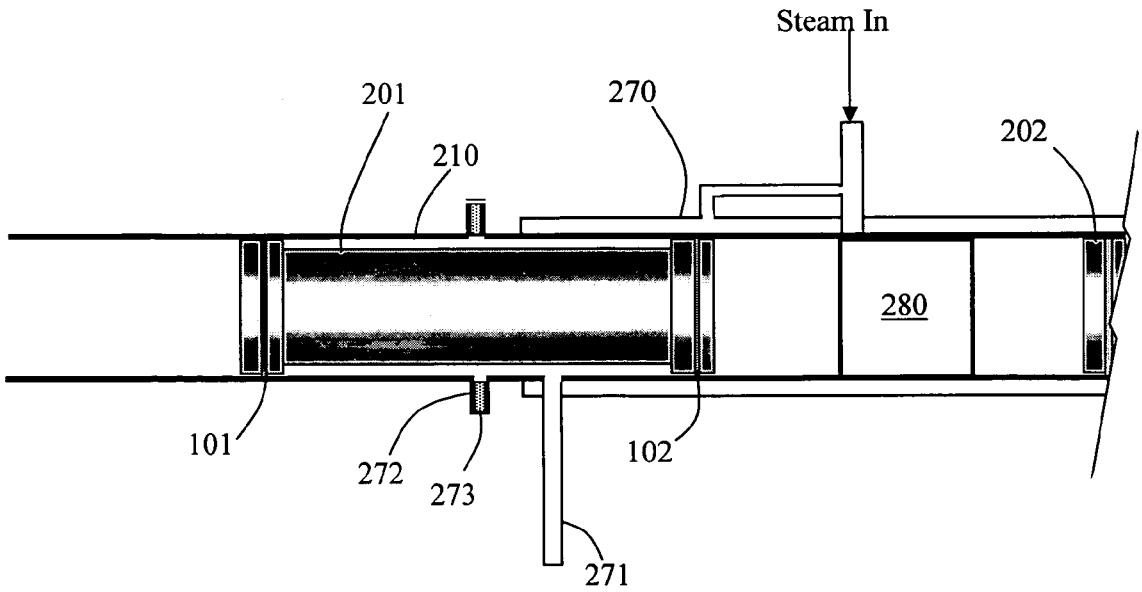
FIG. 10 is a cross-sectional schematic showing one possible construction of the acceleration tube with a steam jacket and a flange assembly for connecting sections of the acceleration tube.

This type of valve along with the steam exhaust pipe 271 shown in FIGS. 8 and 10 could also be used in the Double-Acting Kinetic Pump (FIG. 4) in place of the valve shown in FIG. 6.

Acceleration Tube Construction

The acceleration tube can be made of stainless steel. FIG. 10 shows an enclosing steam jacket 270 around the steam section of the acceleration tube 210 into which high-temperature steam can be introduced in order to keep the wall of the acceleration tube 210 hot and prevent steam condensation inside acceleration tube 210. The steam jacket should be surrounded by insulation (not shown).

To reduce the heat flow along the acceleration tube, the tube can be made in sections. The sections can be held together by flanges 272 that are separated by insulating material 273. The flanged connections should be located at positions such that the O-rings 101 and piston rings 102 do not pass over them.

Calculations of Performance

A computer program called Rampump.f was written to calculate the performance of this vapor-driven kinetic pump. Input data is read into the program to simulate various operating conditions. The first step in the program is to introduce a quantity of superheated steam at constant pressure into chamber 40 of FIG. 1 (or into the space beneath diaphragm 61 of FIG. 2 or corresponding spaces in other figures). Calculation is performed for the acceleration and velocity of the water 9 in tube 10 during this inflow of steam at constant pressure. These quantities depend on the mass of the water, the cross sectional area of the tube, and the volume and pressure of the steam. The amount of work done on the water is $$W_1=P_1V_1,$$

where $P_1$ is the initial steam pressure, and $V_1$ is the volume of steam introduced.

When valve 1 is closed, the program calculates the adiabatic expansion of the steam as it continues to accelerate the water. The steam cools as it expands.

At a specified distance, the water strikes the check valve 23 at the entrance to the compressed-air surge tank 22. The program calculates the deceleration of the water due to the pressure from the surge tank. At the same time, the steam is still pushing from the back, and even though its pressure is much less than the pressure in the surge tank, the steam is still adding energy to pump the water. The computer program calculates the pressure differential to determine the dynamics of the water body and thus to determine the amount of water pumped.

The work done during the adiabatic expansion is given by $$W_2=(P_2V_2-P_1V_1)/(1.0-\gamma),$$

where $P_2$ is the final pressure and $V_2$ is the final volume. $\gamma$ is the ratio of the specific heat at constant pressure to the specific heat at constant volume of the vapor (or gas). The total energy given to the water is $W_1+W_2$.

When the water stops moving, valve 2 opens and the steam flows into the heat exchanger 50. Valve 4, which is a throttle valve or a pressure release valve, maintains the steam at its expanded pressure, which is above the condensation pressure of the condenser 51. Since the feed water entering heat exchanger 50 is cold, some of the steam will condense and release its latent heat to the feed water. Thereafter, the condensed water is blown down into the condenser 51 by the remaining steam. As this remaining steam flows through the heat exchanger 50, it adds more heat to the feed water. In condenser 51, the remaining steam condenses and is pumped back to the heat exchanger 50 and to the boiler 20. The program keeps track of the enthalpy changes by interpolating in steam tables and uses this to calculate the overall efficiency.

The Table 2 gives the theoretical performance values from the computer simulations. Each row is calculated for a set of input parameters for one kilogram of steam per cycle. (In an actual device, the quantity of steam per cycle will be considerably smaller, but this is a convenient unit for calculations). The pump pressure in each case in this table is 70 bars (1,015 psi), although the program is designed to run with any pump pressure. Note that the pump works well when the steam pressure is only 20 bars even though the system is pumping water at 70 bars. Efficiencies are higher for higher steam temperatures.

A number of parameters may be varied to get the desired results. Having a larger diameter acceleration tube 10 allows the tube to be shorter, provides lower velocity water flow, and offers less friction of the water against the wall. It also provides relatively less heat loss to the wall. Making the tube longer and having a greater length of water also gives lower water velocity.

TABLE 2

Steam pressures are given in bars (example, 70 bars = 1,015 psi). The reason for the odd steam temperatures is that the computer calculations were based on the Kelvin scale (427 degrees C. = 700 K). Energy and Enthalpy are given in kilojoules (kJ). The final column gives the theoretical efficiency. In all of these cases, the pump pressure is 70 bars. The numbers are for one kilogram of steam for each cycle. The initial pressures and temperatures are those with which the steam enters chamber 40. The final pressures and temperatures are those of the steam after expansion when the water stops flowing. The "volume of water pumped" is the quantity of water in cubic meters pumped per cycle at 70 bars.

| Initial Steam Pressure (Bars) | Initial Steam Temp. (° C.) | Final Steam Pressure (Bars) | Final Steam Temp. (° C.) | Pump Energy (kJ) | Enthalpy Change (kJ) | Volume of Water Pumped ($m^3$) | Eff. % |
|---|---|---|---|---|---|---|---|
| 20.000 | 427.000 | 3.971 | 223.400 | 656.422 | 2565.496 | 0.094 | 25.5 |
| 20.000 | 427.000 | 2.133 | 161.941 | 759.170 | 2723.660 | 0.108 | 27.8 |
| 20.000 | 727.000 | 1.742 | 331.343 | 1154.969 | 3095.258 | 0.165 | 37.2 |
| 30.000 | 427.000 | 2.446 | 144.316 | 899.631 | 2729.331 | 0.128 | 32.8 |
| 30.000 | 727.000 | 2.453 | 333.051 | 1325.256 | 3066.738 | 0.189 | 43.1 |
| 30.000 | 1227.000 | 2.453 | 636.070 | 1985.965 | 3739.251 | 0.283 | 53.0 |
| 40.000 | 427.000 | 6.433 | 207.093 | 679.311 | 2520.510 | 0.097 | 26.7 |
| 40.000 | 427.000 | 3.688 | 155.028 | 767.281 | 2662.018 | 0.109 | 28.6 |
| 40.000 | 427.000 | 2.041 | 105.830 | 850.418 | 2798.222 | 0.121 | 30.2 |
| 40.000 | 727.000 | 6.461 | 421.452 | 1013.373 | 2835.617 | 0.145 | 35.5 |
| 40.000 | 727.000 | 3.702 | 348.249 | 1146.866 | 3007.462 | 0.164 | 38.0 |
| 40.000 | 1227.000 | 3.701 | 658.859 | 1740.436 | 3677.164 | 0.248 | 47.2 |

TABLE 2-continued

Steam pressures are given in bars (example, 70 bars = 1,015 psi). The reason for the odd steam temperatures is that the computer calculations were based on the Kelvin scale (427 degrees C. = 700 K). Energy and Enthalpy are given in kilojoules (kJ). The final column gives the theoretical efficiency. In all of these cases, the pump pressure is 70 bars. The numbers are for one kilogram of steam for each cycle. The initial pressures and temperatures are those with which the steam enters chamber 40. The final pressures and temperatures are those of the steam after expansion when the water stops flowing. The "volume of water pumped" is the quantity of water in cubic meters pumped per cycle at 70 bars.

| Initial Steam Pressure (Bars) | Initial Steam Temp. (° C.) | Final Steam Pressure (Bars) | Final Steam Temp. (° C.) | Pump Energy (kJ) | Enthalpy Change (kJ) | Volume of Water Pumped ($m^3$) | Eff. % |
|---|---|---|---|---|---|---|---|
| 60.000 | 427.000 | 7.926 | 187.998 | 694.041 | 2499.135 | 0.099 | 27.5 |
| 70.000 | 427.000 | 7.634 | 170.116 | 714.114 | 2515.932 | 0.102 | 28.1 |
| 70.000 | 427.000 | 4.467 | 123.732 | 789.524 | 2649.280 | 0.113 | 29.5 |
| 70.000 | 727.000 | 4.492 | 304.391 | 1244.901 | 3054.535 | 0.178 | 40.5 |
| 70.000 | 1227.000 | 4.492 | 593.073 | 1900.330 | 3784.978 | 0.271 | 50.0 |

Because Table 2 provides only a few of the output quantities from each computer run, one may get a better "feel" for the behavior of the system by considering an example of a pump that may be used in a real solar-powered system. This calculation is based on the design of FIG. 3. The inside diameter of the acceleration tube 110 is 15.24 centimeters (6 inches). The heavy piston 100, made of steel, is one meter long and has 35 centimeters of water 9 sitting on top of it. The acceleration tube is two meters long. The steam pressure is 30 bars (435 psi) and has a temperature of 700 degrees C. (it is superheated steam). The flow of 0.01 kilogram of steam at constant pressure into the tube 110 requires 0.022 seconds and occupies a volume of 1.668 liters. The kinetic energy of the steel piston 100 and the water 9 at this point is 5.00 kilojoules. The steam continues to expand until it reaches a pressure of 3 bars and its volume is 10.52 liters after a total elapsed time of 0.065 seconds. The water velocity is 12.8 meters/second, and the kinetic energy of the water and piston is 12.3 kilojoules.

At this point, the water 9 strikes the check valve and begins to flow into the surge tank as it decelerates. In addition, while the water is decelerating, the steam is still pushing on the back end of the piston 100 so that the total energy given to the piston and water is 12.8 kilojoules. Note that the 12.8 kilojoules of kinetic energy is converted into potential energy in the surge tank 22. The pressure in the surge tank is 70 bars. After 1.75 liters of water flow into the surge tank at a total elapsed time of 0.08 seconds, the water 9 stops. The calculated efficiency is 37%. This number represents the energy of the pumped water compared to the heat input to the boiler. Energy lost to friction inside the acceleration tube 110 is 3.7% of the energy imparted by the steam pressure.

The piston 100 is then be accelerated downward by the force of the incoming makeup water and by the water inlet control rod 103 and by gravity until the makeup water valve 104 closes. The piston 100 then continues to be accelerated by gravity until it reaches the bottom, for a total transit time of 0.3 seconds. The total cycle time is then 0.38 seconds. The pump completes 2.63 cycles per second, and pumps 4.6 liters per second (73 gallons per minute).

These calculations were made with steam. Preliminary calculations seem to show that methanol might have better characteristics. It provides higher pressures than steam at the same temperatures. Lower operating temperatures would make methanol more suitable for the design in FIG. 2. There are many other working fluids that may be even more suitable.

Applications and Advantages

Besides pumping high-pressure water, the pump of the present invention can pump hydraulic oils and other chemicals. It can be used to compress gases to high pressure by using water or other liquid as the ram.

Because this method of the invention can produce high-pressure liquid efficiently, the pressurized liquid can then be directed into a turbine or a positive displacement engine that turns a generator to produce electricity. Because water turbines can be 90% efficient or positive displacement devices can be 85% efficient, the complete system would be efficient. This application might be attractive for small systems, since small steam turbines might have efficiencies of only 25%, which would be reduced to 18% by a gearbox and a generator.

Normally a hydraulic ram pump is considered to be a device that uses a low head of water to produce a small volume of water at higher head. This steam (or other gas) pump can be used in the reverse sense. That is, high-pressure steam can be used to accelerate a long pipe full of water to produce a large volume of water at low head. Thus, a small volume of steam can pump a large volume of low-pressure water.

The system of the invention has no turbine blades, which have friction losses and blow by. There are no gearboxes or rotating shafts to lubricate. Complex machining is not required.

During times in which the sun is shining weakly through high thin clouds, the steam pressure might be low, but the pump would still produce 70 bar water, although at a lower volume.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A kinetic pump comprising:

an acceleration tube for the acceleration of a liquid contained therein by an introduced high-pressure vapor or gas;

a compressed-air surge tank receiving said liquid from said acceleration tube;

a check valve admitting said liquid from said acceleration tube into said compressed-air surge tank;

an outlet for draining said liquid from said compressed-air surge tank; and an inlet for adding additional liquid to said acceleration tube;

wherein during each first half cycle of said pump, said vapor or gas forces said liquid to accelerate in said acceleration tube, whereby a portion of said liquid is forced into said compressed-air surge tank, and wherein during each second half cycle of said pump, said vapor or gas is substantially removed from said acceleration tube and said liquid flows back to its original location and said additional liquid is added to said liquid.

2. A kinetic pump according to claim 1 further comprising:

a boiler for boiling a working fluid, which becomes said vapor;

a heat exchanger for extracting heat energy from said vapor after said vapor exits said acceleration tube and for pre-heating said working fluid before said working fluid enters said boiler;

a pressure reducer valve through which said vapor exits said heat exchanger, wherein said pressure reducer valve restrains flow of said vapor to retain slightly higher pressure of said vapor in said heat exchanger so that a portion of said vapor can condense and release its latent heat to said working fluid; and a condenser for extracting heat energy from said vapor after said vapor exits said heat exchanger and for depositing said heat energy into cooling water.

3. A kinetic pump according to claim 2 wherein heat supplied to said boiler is supplied by a solar energy collector.

4. A kinetic pump according to claim 1 further comprising a float valve inside said liquid outlet, which float valve opens an air valve when a liquid level becomes sufficiently high to allow ambient air to enter an end of said acceleration tube near said check valve, wherein said ambient air which enters said acceleration tube is forced into said compressed-air surge tank upon a next first half cycle of operation as replacement air for air that has dissolved into said liquid.

5. A kinetic pump according to claim 1 wherein said acceleration tube comprises a "U" shape comprising a first vertical column in which said vapor or gas enters to accelerate said liquid, a second vertical column which is attached to said compressed-air surge tank, and a bottom portion connecting said first vertical column to said second vertical column.

6. A kinetic pump according to claim 5 further comprising an insulating float resting upon a surface of said liquid near an entry point of said vapor or gas, said insulating float both decreasing vapor condensation on the surface of said liquid and decreasing Taylor instabilities at an interface between said liquid and said vapor or gas.

7. A kinetic pump according to claim 1 wherein said acceleration tube is substantially vertical, and additionally comprising a pressure chamber and a flexible, stretchable diaphragm, said vertical acceleration tube attached to a top of said pressure chamber, and said flexible, stretchable diaphragm disposed within said pressure chamber to separate said vapor or gas from said liquid.

8. A kinetic pump according to claim 1 wherein said acceleration tube is substantially vertical and comprises a piston within said acceleration tube placing a separation distance between said vapor or gas and said liquid and storing kinetic energy during acceleration by said vapor or gas, said liquid being placed on top of said piston.

9. A kinetic pump according to claim 8 wherein said compressed-air surge tank is connected to a top of said acceleration tube.

10. A kinetic pump according to claim 9 wherein said check valve comprises one or more flapper check valves, and wherein said inlet comprises a first valve admitting replacement liquid into said acceleration tube actuated by said piston, and additionally comprising a second valve admitting said vapor or gas into said acceleration tube actuated by said piston and a third valve releasing said vapor or gas from said acceleration tube, said third valve being closed mechanically by said piston and being opened by hydraulic pressure from said liquid.

11. A kinetic pump according to claim 1 wherein said acceleration tube may be oriented at any angle and comprises a left piston and a right piston within said acceleration tube for placing separation distances between said vapor or gas and said liquid and for storing kinetic energy during acceleration by said vapor, said liquid being placed at a left of said left piston and at a right of said right piston.

12. A kinetic pump according to claim 11 wherein said compressed-air surge tank comprises two compressed-air surge tanks, one connected at a left end of said acceleration tube and another connected at a right end of said acceleration tube.

13. A kinetic pump according to claim 12 wherein said check valve comprises one or more flapper check valves on each end of said acceleration tube, and wherein said inlet comprises a first valve means at each end of said acceleration tube for admitting replacement liquid into said acceleration tube actuated by one of said pistons, and additionally comprising a second valve admitting said vapor or gas into said acceleration tube actuated by one of said pistons, a third valve releasing said vapor or gas from said acceleration tube, said third valve being closed mechanically by one of said pistons and being opened by hydraulic pressure from said liquid, and an air pipe at each end of said acceleration tube inserted into holes in centers of said left and right pistons and connected to said compressed-air surge tanks so that air pressure can accelerate said left and right pistons toward a center of said acceleration tube.

14. A kinetic pump according to claim 11 further comprising a transfer piston near each end of said acceleration tube holding said liquid in place and transferring kinetic energy from said left and right pistons to said liquid, a stop ring near each end of said acceleration tube for limiting travel distance of said transfer pistons, and a check valve at each end of said acceleration tube for admitting replacement liquid into said acceleration tube.

15. A kinetic pump according to claim 1 further comprising a sealed cylinder surrounding a portion of said acceleration tube wherein said vapor or traverses, wherein a portion of said vapor or gas is allowed to flow into said sealed cylinder to supply heat to that portion of said acceleration tube to prevent condensation of said vapor or gas on interior walls of said acceleration tube.

16. A kinetic pump according to claim 1 that pumps high-pressure saline water into a reverse osmosis unit for desalinating water.

17. A kinetic pump according to claim 1 further comprising a turbine or a positive-displacement engine attached to said liquid outlet for the production of shaft power.

18. A kinetic pump according to claim 1 further comprising an external combustion means to supply said vapor or gas to accelerate said liquid.

19. A kinetic pump according to claim 1 further comprising an internal combustion means within said acceleration tube accelerating said liquid.

20. A kinetic pump according to claim 1 pumping a large volume of said liquid at low pressure utilizing a small volume of said vapor or gas at high pressure.

21. A method of pumping a liquid, the method comprising:

providing an acceleration tube for the acceleration of a liquid contained therein by an introduced high-pressure vapor or gas;

receiving the liquid from the acceleration tube with a compressed-air surge tank;

admitting the liquid from the acceleration tube into the compressed-air surge tank via a check valve;

draining the liquid from the compressed-air surge tank from an outlet; and adding additional liquid to the acceleration tube via an inlet;

wherein during each first half cycle of the method, the vapor or gas forces the liquid to accelerate in the acceleration tube, whereby a portion of the liquid is forced into the compressed-air surge tank, and wherein during each second half cycle of the pump, the vapor or gas is substantially removed from the acceleration tube and the liquid flows back to its original location and the additional liquid is added to the liquid.

22. A method according to claim 21 further comprising the steps of:

boiling a working fluid in a boiler, which working fluid becomes the vapor;

extracting heat energy from the vapor with a heat exchanger after the vapor exits the acceleration tube and pre-heating the working fluid before the working fluid enters the boiler;

permitting the vapor to exit the heat exchanger via a pressure reducer valve, wherein the pressure reducer valve restrains flow of the vapor to retain slightly higher pressure of the vapor in the heat exchanger so that a portion of the vapor can condense and release its latent heat to the working fluid; and extracting heat energy from the vapor with a condenser after the vapor exits the heat exchanger and depositing the heat energy into cooling water.

23. A method according to claim 22 wherein heat supplied to the boiler is supplied by a solar energy collector.

24. A method according to claim 21 further comprising employing a float valve inside the liquid outlet, which float valve opens an air valve when a liquid level becomes sufficiently high to allow ambient air to enter an end of the acceleration tube near the check valve, wherein the ambient air which enters the acceleration tube is forced into the compressed-air surge tank upon a next first half cycle of operation as replacement air for air that has dissolved into the liquid.

25. A method according to claim 21 wherein the acceleration tube comprises a "U" shape comprising a first vertical column in which the vapor or gas enters to accelerate the liquid, a second vertical column which is attached to the compressed-air surge tank, and a bottom portion connecting the first vertical column to the second vertical column.

26. A method according to claim 25 further comprising employing an insulating float resting upon a surface of the liquid near an entry point of the vapor or gas, the insulating float both decreasing vapor condensation on the surface of the liquid and decreasing Taylor instabilities at an interface between the liquid and the vapor or gas.

27. A method according to claim 21 wherein the acceleration tube is substantially vertical, and additionally comprising a pressure chamber and a flexible, stretchable diaphragm, the vertical acceleration tube attached to a top of the pressure chamber, and the flexible, stretchable diaphragm disposed within the pressure chamber to separate the vapor or gas from the liquid.

28. A method according to claim 21 wherein the acceleration tube is substantially vertical and comprises a piston within the acceleration tube placing a separation distance between the vapor or gas and the liquid and storing kinetic energy during acceleration by the vapor or gas, the liquid being placed on top of the piston.

29. A method according to claim 28 wherein the compressed-air surge tank is connected to a top of the acceleration tube.

30. A method according to claim 29 wherein the check valve comprises one or more flapper check valves, and wherein the inlet comprises a first valve admitting replacement liquid into the acceleration tube actuated by the piston, and additionally comprising employing a second valve admitting the vapor or gas into the acceleration tube actuated by the piston and a third valve releasing the vapor or gas from the acceleration tube, the third valve being closed mechanically by the piston and being opened by hydraulic pressure from the liquid.

31. A method according to claim 21 wherein the acceleration tube may be oriented at any angle and comprises a left piston and a right piston within the acceleration tube for placing separation distances between the vapor or gas and the liquid and for storing kinetic energy during acceleration by the vapor, the liquid being placed at a left of the left piston and at a right of the right piston.

32. A method according to claim 31 wherein the compressed-air surge tank comprises two compressed-air surge tanks, one connected at a left end of the acceleration tube and another connected at a right end of the acceleration tube.

33. A method according to claim 32 wherein the check valve comprises one or more flapper check valves on each end of the acceleration tube, and wherein the inlet comprises a first valve means at each end of the acceleration tube for admitting replacement liquid into the acceleration tube actuated by one of the pistons, and additionally comprising employing a second valve admitting the vapor or gas into the acceleration tube actuated by one of the pistons, a third valve releasing the vapor or gas from the acceleration tube, the third valve being closed mechanically by one of the pistons and being opened by hydraulic pressure from the liquid, and an air pipe at each end of the acceleration tube inserted into holes in centers of the left and right pistons and connected to the compressed-air surge tanks so that air pressure can accelerate the left and right pistons toward a center of the acceleration tube.

34. A method according to claim 31 further comprising employing a transfer piston near each end of the acceleration tube holding the liquid in place and transferring kinetic energy from the left and right pistons to the liquid, a stop ring near each end of the acceleration tube for limiting travel distance of the transfer pistons, and a check valve at each end of the acceleration tube for admitting replacement liquid into the acceleration tube.

35. A method according to claim 21 further comprising employing a sealed cylinder surrounding a portion of the acceleration tube wherein the vapor or gas traverses, wherein a portion of the vapor or gas is allowed to flow into the sealed cylinder to supply heat to that portion of the acceleration tube to prevent condensation of the vapor or gas on interior walls of the acceleration tube.

36. A method according to claim 21 that pumps high-pressure saline water into a reverse osmosis unit for desalinating water.

37. A method according to claim 21 further comprising employing a turbine or a positive-displacement engine attached to the liquid outlet for the production of shaft power.

38. A method according to claim 21 further comprising employing an external combustion means to supply the vapor or gas to accelerate the liquid.

39. A method according to claim 21 further comprising employing an internal combustion means within the acceleration tube accelerating the liquid.

40. A method according to claim 21 pumping a large volume of the liquid at low pressure utilizing a small volume of the vapor or gas at high pressure.

* * * * *